United States Patent [19]

Nakai et al.

[11] Patent Number: 4,613,092

[45] Date of Patent: Sep. 23, 1986

[54] SPINDLE ASSEMBLY FOR WINDING MACHINE

[75] Inventors: Shoji Nakai, Ibaraki; Koji Akimoto, Itami, both of Japan

[73] Assignee: Kamitsu Seisakusho Ltd., Hyogo, Japan

[21] Appl. No.: 710,868

[22] Filed: Mar. 12, 1985

[30] Foreign Application Priority Data

Mar. 16, 1984 [JP] Japan ..... 59-49327

[51] Int. Cl.[4] ..... B65H 54/547; B65H 75/30

[52] U.S. Cl. ..... 242/46.4

[58] Field of Search ..... 242/46.4, 46.2, 46.3, 242/72 R, 72.1, 18 DD, 68.2, 68.1

[56] References Cited

U.S. PATENT DOCUMENTS

| | | | |
|---|---|---|---|
| 3,462,092 | 8/1969 | Mullins | 242/46.4 |
| 3,494,565 | 2/1970 | Mullins | 242/46.4 |
| 3,495,781 | 2/1970 | Graf et al. | 242/46.4 |
| 3,700,249 | 10/1972 | Allam | 242/46.4 X |
| 3,722,807 | 3/1973 | Swinehart | 242/46.4 X |
| 3,722,808 | 3/1973 | Brown | 242/46.4 |
| 3,977,616 | 8/1976 | Owens et al. | 242/46.4 |
| 4,232,835 | 11/1980 | Benin | 242/46.4 |
| 4,241,883 | 12/1980 | Benin | 242/46.4 |
| 4,436,249 | 3/1984 | Santa Lucia et al. | 242/46.4 X |
| 4,453,677 | 6/1984 | Holzer | 242/46.4 X |

*Primary Examiner*—Stanley N. Gilreath

*Attorney, Agent, or Firm*—Burgess, Ryan & Wayne

[57] ABSTRACT

A spindle assembly capable of accomplishing a swing movement of a spindle bearing mechanism to a machine frame, an operation of holding bobbins on and releasing bobbins from a spindle, and an operation of actuating a rotation stopping mechanism by a sliding movement of an operation handle.

In the spindle assembly according to the present invention, a first support and a second support are secured to a front end of the spindle rotatably supported at the rear end on the spindle cradle. Bobbin holding members are inserted into slits arranged on circumferential portions of the first support and the second support and moved outwardly or inwardly in the radial direction while a rear end of a sliding cylinder attached to an operation handle, which is capable of freely rotating, is inserted into an inside of the first support and engaged with projections of the bobbin holding members. Since the rear end of the sliding cylinder is formed into a conical shape, when the operation handle is drawn out, the bobbin holding members are moved inward in the radial direction, so that the bobbin can be removed from the spindle.

A stop operation of the spindle is performed by engaging a frictional piece moved by rods passing through the first support and the second support by the operation handle with a conical gap of a braking cylinder secured to the spindle cradle.

4 Claims, 12 Drawing Figures

SPINDLE ASSEMBLY FOR WINDING MACHINE

BACKGROUND OF THE INVENTION (1) Field of the Invention

The present invention relates to a spindle assembly to be used for a winding machine of the type where a spindle having a bobbin mounted thereon is driven, a yarn guided by a traverse device is wound on the bobbin, and the spindle is moved away from the traverse device in accordance with an increase in the amount of yarn wound on the bobbin.

(2) Description of the Related Art

The following procedures must be carried out when operating spindle assembly in a winding machine of the above-mentioned type.

(1) A bobbin is attached to and removed from a spindle of the spindle assembly.

(2) When a full bobbin is removed from or an empty bobbin is attached to the spindle of the spindle assembly, the spindle assembly is either moved away from or brought closer to the traverse device.

(3) The spindle of the spindle assembly is stopped.

In known winding machines, the foregoing procedures (1) through (3) are independently performed by an operator. For example, in the conventional winding machine disclosed in the specification of U.S. Pat. No. 3,452,941, a bobbin is attached to the spindle of the spindle assembly by turning a handle arranged vertically to the spindle. However, the spindle assembly is moved and the spindle stopped in the spindle assembly by other separate devices. In a winding machine, generally, a great number of spindles are arranged in all parts of the machine. Accordingly, if a plurality of operating devices are disposed for the spindle assembly as described above, the overall structure of the winding machine becomes complicated and the machine must occupy a greater space. This also makes the operations to be carried out by the operator much more complex.

SUMMARY OF THE INVENTION

It is a primary object of the present invention to provide a spindle assembly in which the operations of attaching a bobbin to and removing the bobbin from a spindle, moving the spindle assembly, and stopping the spindle are accomplished merely by turning only an operating handle arranged in the spindle assembly.

Another object of the present invention is to provide a spindle assembly having a simple structure by which a winding machine which is safe and easy to handle can be constructed.

In accordance with the present invention, these objects can be attained by providing a spindle assembly for a winding machine in which a yarn is wound by driving a spindle having a bobbin mounted thereon and the spindle is moved away from a traverse device in accordance with an increase in the amount of yarn wound on the bobbin. The spindle assembly comprises a spindle cradle swingably supported on a machine frame of the winding machine, a spindle having a rear end thereof rotatably supported in the spindle cradle and a free end, an expander mechanism mounted on the spindle, at least one end of the expander mechanism being located forward of the free end of the spindle, a plurality of bobbin holding members, at least one end of each of the bobbin holding members being held by the expander mechanism so that the holding member can be moved in a radial direction relative to the spindle, a rotation stopping mechanism secured to the spindle cradle for braking the rotation of the spindle, and an operating handle attached to the expander mechanism in such a manner that the operating handle can slidably move in parallel to the axis of the spindle. The expander mechanism is constructed in such a manner that when the operating handle is moved in one direction, the expander mechanism pushes the bobbin holding members outward in the radial direction to hold the bobbins, and when the operating handle is moved in the opposite direction, the expander mechanism pulls the bobbin holding members inward in the radial direction to release the bobbins. The rotation stopping mechanism is constructed in such a manner that the spindle is braked or released from braking in accordance with the direction of the sliding movement of the operat hanndle. Thus, the swinging movement of the spindle cradle to the machine frame, the operation of holding bobbins on and releasing bobbins from the spindle, and the operation of actuating the rotation stopping mechanism are accomplished by the sliding operation of the operating handle.

DETAILED DESCRIPTION OF THE PREFERRED EMBODIMENT

The present invention will now be described in detail with reference to the accompanying drawings illustrating the preferred embodiment of the spindle assembly according to the present invention.

Figure 1:
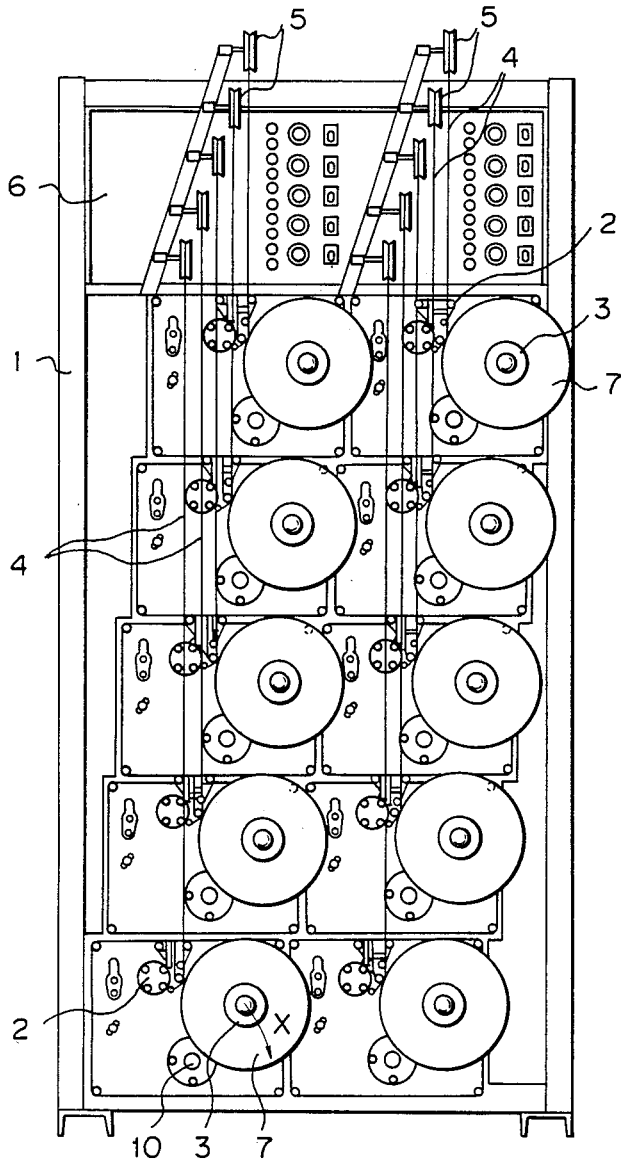
FIG. 1 is a front view of a winding machine in which a plurality of spindle assemblies according to the present invention are arranged.
Figure 2:
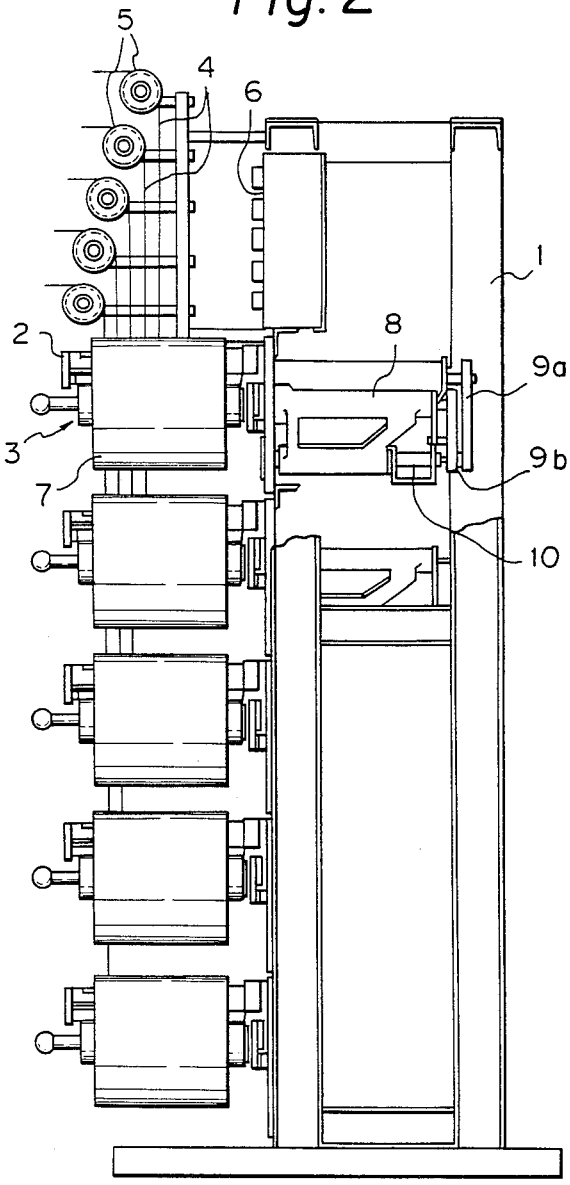
FIG. 2 is a side view of the winding machine shown in FIG. 1.

FIGS. 1 and 2 illustrate a winding machine in which the spindle assemblies according to the present invention are arranged in two rows and five stages (10 assemblies in total). In FIGS. 1 and 2, reference numerals 1, 2, 3, 4, 5, 6, 7, and 8 represent a frame of the winding machine, a traverse device, a spindle assembly, a yarn, a guide roller, a electric controlling box, a yarn package, and a bearing mechanism such as a spindle cradle, respectively. The traverse device 2 and the spindle of the spindle assembly 3 are driven by belts 9*a* and 9*b*, respectively, and the revolution ratio between a traverse cam (not shown) and the spindle is kept constant. The spindle assembly 3 is rotatably supported on the spindle cradle 8 and the spindle cradle 8 is swingably supported by a bearing assembly 10. Accordingly, as the diameter of the yarn package 7 increases in accordance with the amount of yarn wound on a bobbin held on the spindle assembly 3, the spindle assembly 3 is correspondingly moved in a direction indicated by an arrow X in FIG. 1.

The preferred embodiment of the spindle assembly according to the present invention is illustrated in FIGS. 3 through 12.

Figure 3:
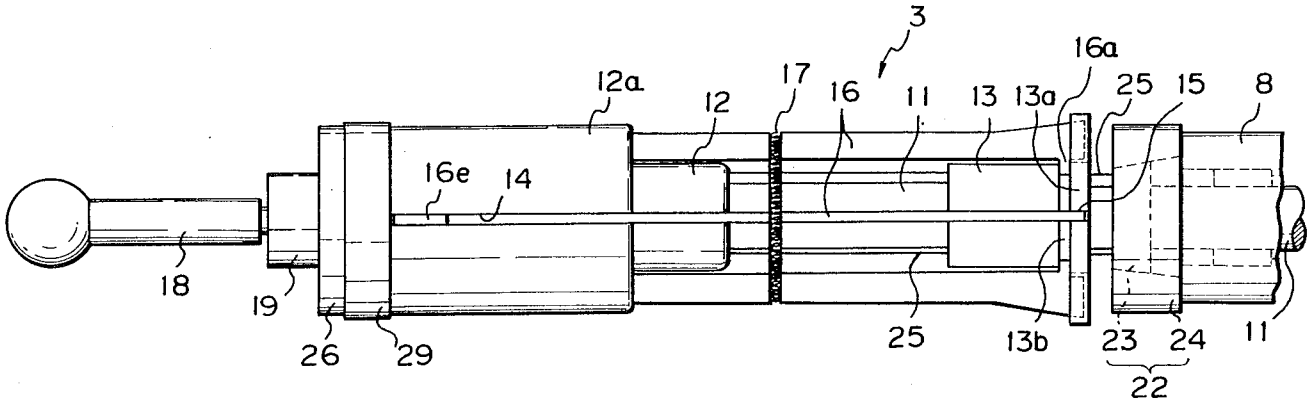
FIG. 3 is a side view illustrating an embodiment of the spindle assembly according to the present invention.
Figure 4:
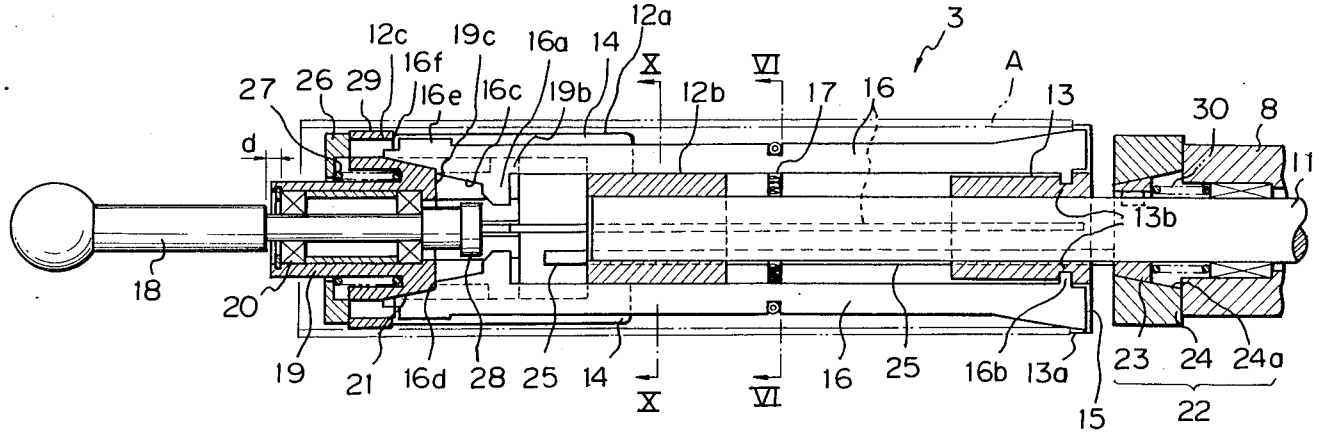
FIG. 4 is an axial sectional view of the spindle assembly shown in FIG. 3, illustrating the state wherein a bobbin holding member of the spindle assembly is contracted.
Figure 5:
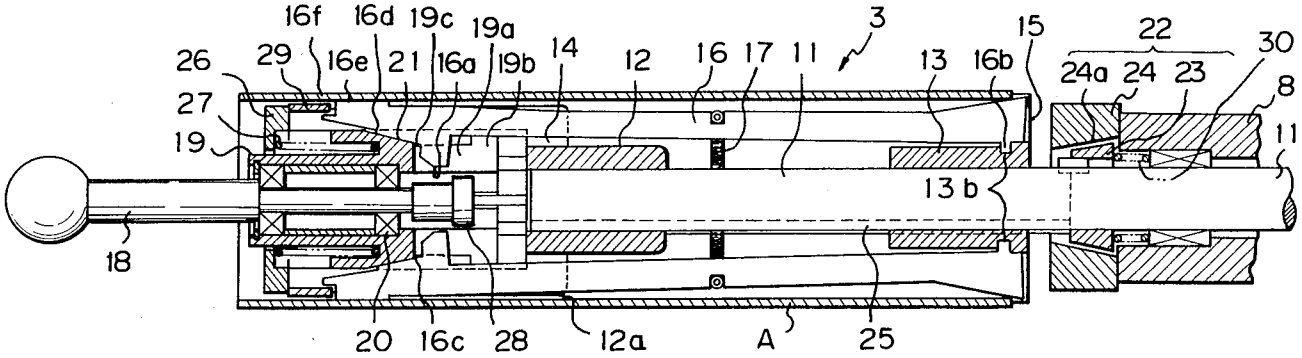
FIG. 5 is an axial sectional view of the spindle assembly shown in FIG. 3, illustrating the state wherein the bobbin holding member of the spindle assembly is expanded.

As shown in FIGS. 3, 4, and 5, the rear end (to the right in the drawings) of the spindle 11 is rotatably supported on the spindle cradle 8, and the front end (to the left in the drawings) and midway portion of the spindle 11 are supported by a first support 12 and a second support 13, respectively, in such a manner that the supports 12 and 13 are spaced a predetermined distance apart, as shown in the sectional views of FIGS. 4 and 5. As shown in detail in FIGS. 8 and 9, the first support 12 has a cylindrical structure comprising a small-diameter portion 12*b* at the rear end, a large-diameter middle portion 12*a*, and a small-diameter portion 12*c* at the front end. Four slits 14 are equidistantly and radially arranged along the axial direction in the large-diameter middle portion 12*a* and the small-diameter portion 12*c* at the front end. As shown in detail in FIG. 11, the second support 13 has a cylindrical structure similar to that of the first support 12, but a flange 13*a* is arranged at the rear end of the second support 13 and radial slits 15 corresponding to the slits 14 of the first support 12 are formed in this flange 13*a*. A concave groove 13*b* (see FIGS. 4 and 5) is formed between the body 13*c* of the second support 13 and the flange 13*a*.

Figure 7:
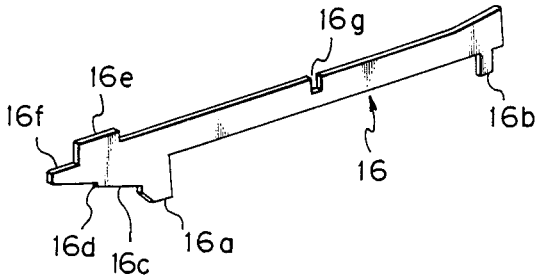
FIG. 7 is a perspective view showing the bobbin holding member of the spindle assembly shown in FIG. 3.
Figure 8:
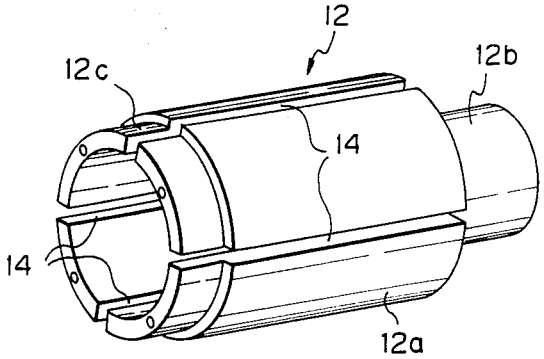
FIG. 8 is a perspective view showing a first support of the spindle assembly shown in FIG. 3.
Figure 9:
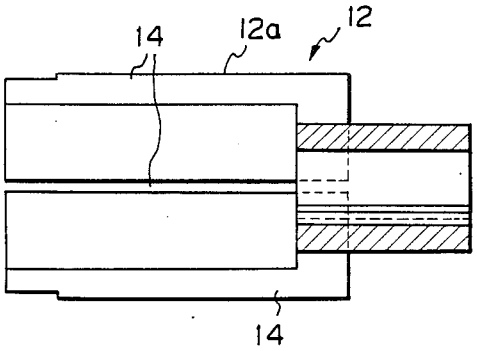
FIG. 9 is an axial sectional view of the first support shown in FIG. 8.
Figure 10:
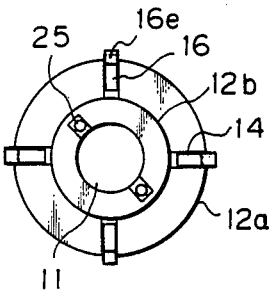
FIG. 10 is a view showing the section taken along the line X—X in FIG. 4.
Figure 11:
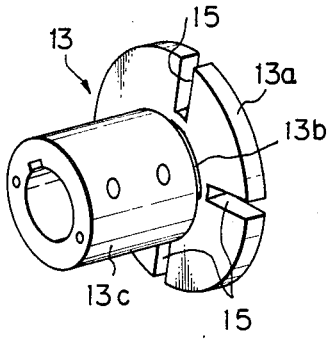
FIG. 11 is a perspective view showing a second support of the spindle assembly shown in FIG. 3.

FIG. 7 shows a bobbin holding member 16 formed of a plate and having the shape shown in the figure. Namely, the bobbin holding member 16 has a first projection 16*a* (lower left end in FIG. 7), a second projection 16*b* (lower right end in FIG. 7) and a groove 16*g* substantially in the center of the upper side. Furthermore, the bobbin holding member 16 has a stepped inclined part 16*c*, a step 16*d*, an upper projection 16*e*, and an end projection 16*f* formed as shown on the left in FIG. 7.

Figure 6:
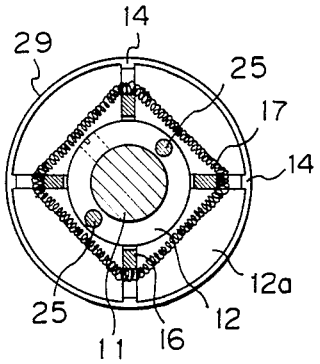
FIG. 6 is a view showing the section taken along the line VI—VI in FIG. 4.

As shown in FIGS. 4 and 5, four bobbin holding members 16 having the structure shown in FIG. 7 are inserted in the slits 14 of the first support 12 and the slits 15 of the flange 13*a* of the second support 13, to set the relative positions of the bobbin holding members 16, and the second projections 16*b* of the bobbin holding members 16 are inserted in the concave groove 13*b* of the second support 13 to set the position of the spindle assembly 3 relative to the axial direction. To ensure the engagement and holding of the four bobbin holding members 16 on the first support 12 and second support 13, that is, the spindle 11, a spring 17 is fitted radially in the grooves 16*g*, respectively, as shown in FIG. 6.

Figure 12:
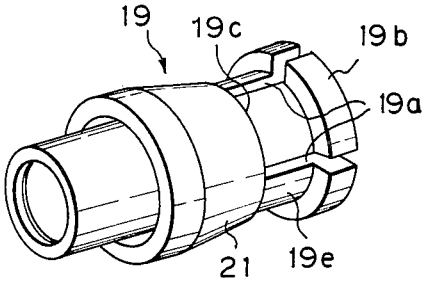
FIG. 12 is a perspective view showing a sliding cylinder of the bobbin assembly shown in FIG. 3;.

In the spindle assembly 3 according to the present invention, the above-mentioned four bobbin holding members 16 are moved outwardly in the radial direction, to hold a bobbin. An operating handle 18 is moved in the axial direction within a limited range d and a sliding cylinder 19 is attached to the operating handle 18 in such a manner that it can freely rotate through a bearing 20. The sliding cylinder 19 has a cylindrical shape as a whole as shown in FIG. 12, but radial slits 19*a*, a flange 19*b*, and a step 19*c* are formed at the rear end of the cylinder 19. A conical part 21 is formed forward of the step 19*c*.

The operating handle 18 and sliding cylinder 19 are inserted into the cylinder of the large-diameter middle portion 12*a* of the first support 12 in such a manner that the flange 19*b* is brought into contact with the inner wall of the cylinder of the large-diameter middle portion 12*a*. Undesirable forward movement (to the left in FIGS. 3, 4 and 5) of the sliding cylinder 19 having the first projections 16*a* of the bobbin holding members 16 inserted in the slits 19*a* thereof is prevented by a spring 27 placed between the sliding cylinder 19 and a receiving plate 26 secured to the front face of the front end small-diameter portion 12*c* of the first support 12. The operating handle 18 is arranged in front of the spindle 11 on the same axial line, and a turning wheel-shaped projection 28 mounted on bearings to be engaged with and disengaged from the first projections 16*a* of the respective bobbin holding member 16, is arranged on the end of the operating handle 18 inserted into the sliding cylinder 19. A stop ring 29 is fitted to the front end of the first support 12 and surrounds the end portions 16*f* of the respective bobbin holding members 16 so that the end portions 16*f* of the bobbin holding members 16 are prevented from excessive expansion in a radial direction. The expander mechanism of the spindle assembly 3 of the present invention is constructed by combining the first support 12 with the sliding cylinder 19.

A mechanism 22 for braking and stopping the rotation of the spindle is arranged at the front end of the spindle cradle 8. More specifically, a cone-shaped frictional piece 23 is located in a conical gap 24*a* of a braking cylinder 24. The frictional piece 23 is key-connected to the spindle 11 in such a manner that the frictional piece 23 is moved in the axial direction relative to the spindle 11 and rotated integrally with the spindle 11. The frictional piece 23 is pressed and urged in the small-diameter direction of the conical hole 24*a* by a spring 30 in such a manner that, in the normal state, the rotation of the spindle 11 is braked by frictional engagement of the frictional piece 23 with the braking cylinder 24. As clearly shown in FIG. 10, the first support 12 and second support 13 have slots respectively in which a plurality of rods 25 are slidably mounted, one end of these rods 25 pushing against the cone-shaped friction piece 23.

The operation of the spindle assembly 3 according to the present invention will now be described.

When the operating handle 18 is drawn out (to the left in the drawings) against the spring 27, i.e., from the state shown in FIG. 5 to the state shown in FIG. 4, the sliding cylinder 19 is drawn out in the same direction together with the handle 18. Accordingly, the conical part 21 is moved forward and each bobbin holding member 16 clamped by the spring band 17 and in contact at the tapered edge 16*c* with the conical part 21 is allowed to move inward in the radial direction, and thus the diameter of the four bobbin holding members 16 as a whole is contracted. In this state, the sliding cylinder 19 is anchored stably at a predetermined position by engagement of the steps 16*d* of the bobbin holding members 16 with the step 19*c* of the sliding cylinder 19. At this point, a free movement portion (or gap) d is produced between the operating handle 18 and the sliding cylinder 19. The rods 25 are also moved forward by this forward movement of the sliding cylinder 19, and thus allow the cone-shaped frictional piece 23 in the stopping mechanism 22 to be urged toward the small-diameter side of the conical hole 24*a* by the spring 30. This brings the frictional piece 23 into frictional engagement with the stationary braking cylinder 24, producing a braking action on and stopping the rotation of the spindle 11. Accordingly, a full bobbin A can be easily removed since the spindle 11 is stopped and the diameter of the bobbin holding members 16 as a whole is contracted.

As shown in FIG. 5, when an empty bobbin is mounted, the operating handle 18 is pushed inward. At first, only the handle 18 is pushed inward by the length of the free movement portion d, causing the turning wheel 28 located on the pressing end of the handle 18 to press the inclined faces of the projections 16*a* of the bobbin holding member 16, whereby the bobbin holding members 16 are outwardly expanded and the sliding cylinder 19, anchored to the step 19*c* of the sliding cylinder 19 by engagement of the steps 16*d* of the bobbin holding members 16, is released. Subsequent inward pushing of the operating handle 8, causes the sliding cylinder 19 to be moved backward by the urging action of the spring 27. This movement of the sliding cylinder 19 also causes the conical part 21 to move backward and press against the tapered edges 16*c* of the respective bobbin holding members 16, which are thus expanded outwardly to increase the bobbin holding diameter of the bobbin holding members 16 as a whole. As a result, the upper projections 16*e* of the respective bobbin holding members 16 are pressed against the inner face of the bobbin A, and thus the bobbin A is firmly secured. Simultaneously, the rods 25 are pushed backward by the movement of the sliding cylinder 19 caused by the inward pushing of the operating handle 18. The rods 25 then push on and move the cone-shaped frictional piece 23 of the stopping mechanism 22 toward the large-diameter portion of the conical hole 24*a*, thereby releasing the braking action on the spindle 11 and allowing it to rotate to effect the winding operation.

Note, although the sliding cylinder 19 is rotated together with the spindle 11 when the spindle 11 is rotated, the operating handle 18 is insulated from the rotation of the spindle 11 and sliding cylinder 19 through the bearing 20 and, hence, the operation of pushing and withdrawing the operating handle 18 can be performed safely and easily without risk.

Further, the spindle 11 and the spindle cradle 8 supporting the spindle 11 can be swung between a position closer to the traverse device 2 and a position remote from the same by moving the operation handle 8 about the axis 10.

The effects attained by the present invention will now be described.

As is apparent from the foregoing description, the diameter of the bobbin-holding portion defined by the bobbin holding members 16 can be contracted and expanded by the operation of pushing and withdrawing the single operating handle 18, and simultaneously, the rotation of the spindle 11 is stopped and started by the single operating handle 18. Accordingly, the mounting and dismounting of bobbins is greatly facilitated, and since the operating handle 18 is located on the same axial line as the spindle 11, the spindle can be moved simply and safely by the manual movement of the operating handle 18. Further, according to the present invention, the space occupied by the equipment can be reduced and a plurality of winding units can be advantageously arranged, and the structure of the equipment can be simplified.

We claim:

1. A spindle assembly for a winding machine of the type having a rotatable spindle for supporting a bobbin thereon which is to have a yarn wound said bobbin, and a traverse device from which said spindle moves away in accordance with an increase in the amount of yarn wound on the bobbin, said spindle assembly comprising:

a bearing mechanism swingably supported on a machine frame of the winding machine, a spindle having a rear end thereof rotatably supported about an axis thereof by said bearing mechanism, and an opposite, free end, an operating handle slidably movable parallel to the axis of the spindle, a plurality of bobbin holding members movable in a radial direction relative to the spindle, expander means for pushing the bobbin holding members outwardly in the radial direction to hold a bobbin when the operating handle is slidably moved in a first direction and for drawing the bobbin holding members inwardly in the radial direction to release said bobbin when the operating handle is slidably moved in a second, opposite direction, said expander means being mounted on the spindle, attached to said operating handle and in engagement with said bobbin holding members, pander means mounted on the spindle, attached to said operating handle and in engagement with said bobbin holding members, rotation stopping means secured to the bearing mechanism for braking said spindle or for permitting said spindle to rotate in dependence on the direction of slidable movement of said operating handle, and wherein swinging movement of the spindle cradle to the machine frame, the operation of holding a bobbin on and releasing a bobbin from the spindle, and the operation of actuating the rotation stopping means are accomplished by the sliding operation of the operating handle.

2. A spindle assembly according to claim 1, wherein the expander means is comprised of a support secured to the free end of the spindle, having a cylindrical structure and a plurality of slits arranged on a circumferential surface thereof in an axial direction of the spindle, and a sliding cylinder having a portion formed in conical shape, a rear end of which is inserted into said support, and a front end of which is connected with said operation handle capable of sliding in parallel to the axis of the spindle;

a spring being arranged between said front end of the sliding cylinder and a receiving plate secured to a front face of the support, said spring always urging said sliding cylinder away from said receiving plate;

said bobbin holding members each formed of a plate and including a projection, a stepped inclined part, a step and an upper projection arranged on a front end thereof, each bobbin holding member being inserted in said slits of said support, and a spring arranged radially around the bobbin holding members to ensure engagement with and holding of said bobbin holding member on said support;

said operation handle including a turning wheel arranged on one end thereof and engaging with and disengaging from said projections of said bobbin holding members;

said rotation stopping means includes a cone-shaped frictional piece key-connected to said spindle, moved in the axial direction relative to said spindle and rotated integrally with said spindle, a braking cylinder secured to the bearing mechanism of the winding machine, and having a conical hole in which said cone-shaped frictional piece is arranged, and a spring arranged between said bearing mechanism and said cone-shaped frictional piece;

whereby, when the operation handle is pulled out, said bobbin holding members are moved inward in the radial direction of the spindle by said spring arranged radially around said bobbin holding members, the force of said spring being activated by displacement of said sliding cylinder in said second direction caused by the displacement of said operation handle, whereupon engagement of said upper projections of said bobbin holding members with a bobbin arranged on said spindle assembly is released, and rotation of said spindle is stopped by engagement of said friction piece with said braking cylinder in said conical hole thereof by the expanding force of said spring between said bearing mechanism and said friction piece; and wherein, when said operation handle is pushed inward after mounting a bobbin, said bobbin holding members are moved outwardly in the radial direction by the movement of said sliding cylinder in said first direction in accordance with the movement of said operation handle so that said conical portion of said sliding cylinder advances along said stepped inclined parts of said bobbin holding members after engagement between said sliding cylinder and said steps of said bobbin holding members is released, whereupon said upper projections of said bobbin holding members then engage with an inside of said bobbin to hold said bobbin in place, and the engagement between said friction piece and said braking cylinder is released by moving said friction piece backward by means of rods provided between said operation handle and said friction piece.

3. A spindle assembly according to claim 1, wherein said bearing mechanism is a spindle cradle.

4. A spindle assembly according to claim 2, wherein said spindle assembly further comprises a second support having a cylindrical structure similar to that of said support of said expander means, a flange arranged on a rear end of the second support, and a concave groove formed between a body of the support and the flange, said second support arranged on the spindle at a position remote from the position of said support of said expander means by a predetermined distance;

said bobbin holding members include a further projection provided at a rear end thereof;

whereby lengthwise positions of said bobbin holding members are defined by inserting said further projection into said concave groove of said second support.

* * * * *